United States Patent [19]

Bingham

[11] Patent Number: 4,644,759

[45] Date of Patent: Feb. 24, 1987

[54] HEAT PUMP AND METHOD

[75] Inventor: Grady A. Bingham, Muscle Shoals, Ala.

[73] Assignee: Thermal Concepts, Inc.

[21] Appl. No.: 879,930

[22] Filed: Jun. 30, 1986

Related U.S. Application Data

[63] Continuation of Ser. No. 737,270, May 23, 1985, Pat. No. 4,598,558, which is a continuation-in-part of Ser. No. 681,365, Dec. 13, 1984, abandoned.

[51] Int. Cl.[4] ..... F25B 13/00

[52] U.S. Cl. ..... 62/324.1; 62/160; 62/263

[58] Field of Search ..... 62/263, 324.1, 160, 62/259.1, 412; 165/48 R, 62

[56] References Cited

U.S. PATENT DOCUMENTS

| | | | |
|---|---|---|---|
| 2,118,949 | 5/1938 | Scott | 62/171 |
| 2,175,946 | 10/1939 | Smith | 62/129 |
| 2,847,834 | 8/1958 | Atchison | 62/263 |
| 2,894,375 | 7/1959 | Waterfill | 62/196 |
| 3,128,607 | 4/1964 | Kyle | 62/158 |
| 3,170,304 | 2/1965 | Hale | 62/155 |
| 3,779,031 | 12/1973 | Akiyama et al. | 62/160 |
| 4,203,302 | 5/1980 | Lapeyre | 62/259 |
| 4,265,093 | 5/1981 | Newton | 62/198 |
| 4,340,404 | 7/1982 | Oonishi et al. | 62/198 |
| 4,424,686 | 1/1984 | Lapeyre et al. | 62/259.1 |
| 4,505,328 | 3/1985 | Schmitt | 62/263 |

*Primary Examiner*—Lloyd L. King

[57] ABSTRACT

A heat pump and method are presented which includes a compact two-compartment housing in which each compartment contains a condensor-evaporator. The heat pump which has upper and lower compartments which are vertically aligned is installed totally within the interior of a building and air from the attic area of the building is used as a supply while spent air is exhausted below the heat pump and no outside wall space is required for installation. The method of operation includes reversing the refrigerant flow and during the heating cycle condensate from the upper condensor-evaporator is directed to the lower condensor-evaporator to provide humidity to the interior of the building.

18 Claims, 5 Drawing Figures

HEAT PUMP AND METHOD

This is a continuation of application Ser. No. 06/737,270 filed 23 May 1985, now U.S. Pat. No. 4,598,558 which was a continuation-in-part of application Ser. No. 06/681,365 filed 13 Dec. 1984, now abandoned.

BACKGROUND OF THE INVENTION

1. Field of the Invention

The invention herein pertains to a device for air to air cooling and heating the interior of a building by directing the flow of a refrigerant from a compressor through two heat exchangers which are commonly referred to as evaporators or condensers.

2. Description of the Prior Art and Objectives of the Invention

Engineers have known for many years that the evaporator and condenser in refrigeration equipment can be interchanged by reversing the direction of the refrigerant (freon) flow from the compressor. By reversing the flow direction either a heating or cooling function can be performed and such refrigeration equipment which is commonly referred to as a heat pump generally includes an outdoor coil which is positioned on the exterior of the building, an indoor coil positioned within the building and an expansion valve for reducing the pressure of the refrigerant. Both the indoor and outdoor coil function as a condenser or as an evaporator as determined by the mode of the heat pump.

Various types of heat pumps having reverse refrigerant cycles which may be either self contained or split (condenser and evaporator in separate locations) have met with moderate success in certain installations but have also had certain disadvantages. For example, corrosion can greatly shorten the life of a conventional outdoor coil, especially in areas which have a high salt air content. In addition, the outdoor coil is directly exposed to the extreme seasonal elements which may hamper its function in all modes of operation. Also, conventional heat pumps dehumidify the air and auxiliary equipment must be installed to maintain a suitable interior building humidity. Small residential structures including trailers or modular homes often have a high heat buildup in the attic area during summer months which require fans or other venting systems that create additional concerns and require additional energy expenditures.

With these and other disadvantages known to current heating and cooling systems, the present invention was conceived and one of its objectives is to provide a heat pump and method which is economical to use and provides satisfactory results and low maintenance and operating cost for the user.

It is another objective of the present invention to provide a heat pump with both the "indoor coil" and "outdoor coil" within a single housing and in which the "indoor coil" and "outdoor coil" are adjacently mounted in separate compartments or chambers with the housing located entirely within the conditioned building structure.

It is still another objective of the present invention to provide a heat pump which delivers exterior air across the "outdoor coil" from the attic or crawl space of the building and which exhausts that same air from the heat pump housing to the exterior and requires no outside wall for installation, thereby reducing the wind chill and defrosting of the "outdoor coil", subsequently reducing the defrost cycles and without direct exposure of the "outdoor coil" to the sun's solar hear and outside ambient temperature.

It is yet another objective of the present invention to utilize the condensate collected from the evaporator to humidify the interior air during the heating cycle.

It is another objective of the present invention to provide a condensate drain through the exterior exhaust duct to minimize installation costs.

It is still another objective of the present invention to provide an air to air heat pump and method with 100% elimination of outside noise.

An additional advantage of the invention is to provide a heat pump and method which is readily adaptable to auxiliary heat sinks and sources without substantial alteration to the apparatus.

It is also an objective of the present invention to provide a heat pump having an economic operation with high indoor air quality as a result of a controllable mix of indoor and outdoor air.

Various other advantages and objectives of the invention will become apparent to those skilled in the art as a more detailed presentation of the invention is set forth below.

SUMMARY OF THE INVENTION

The aforesaid and other objectives of the invention are accomplished by utilizing a heat pump which comprises a two compartment configuration wherein the first compartment includes a compressor, a first condenser-evaporator and a first fan and the second compartment which is positioned vertically below the first compartment includes a reversing valve, a second condenser-evaporator and a second fan (the term condenser-evaporator is used herein to designate the dual function of the component).

The method of the invention includes directing the compressed refrigerant gas which may be freon to a reversing valve where, dependng on whether the heating or cooling cycle is employed, either passing the compressed gas to the upper condenser-evaporator over which exterior air is passed for exhaust purposes or passing the compressed gas to the lower condenser-evaporator which conditions the interior air.

DESCRIPTION OF THE PREFERRED EMBODIMENTS

The preferred embodiment of the apparatus includes a housing having an upper compartment with a first condenser-evaporator, a compressor and an air entry duct through which air from an attic area is delivered. A lower or second compartment is provided with a second condenser-evaporator through which interior room air passes for conditioning. The first and second compartments are vertically aligned to provide compactness and air from the first compartment is exhausted through the bottom of the heat pump and therefore no exterior wall is required for installation purposes. The preferred method of the invention comprises directing air from an attic area of the building structure by a fan positioned in front of the condenser-evaporator within the upper compartment of the heat pump and exhausting the spent air as it passes from the condenser-evaporator through the bottom of the heat pump to an area underneath the building. Interior room air is circulated by a second fan positioned within the bottom or second compartment of the heat pump through a second condenser-evaporator where it is returned to the interior of the building for heating or cooling. During the heating cycle, condensate is drained from the upper condenser-evaporator to the lower condenser-evaporator for use in humidifying the room air.

DETAILED DESCRIPTION OF THE DRAWINGS

Figure 1:
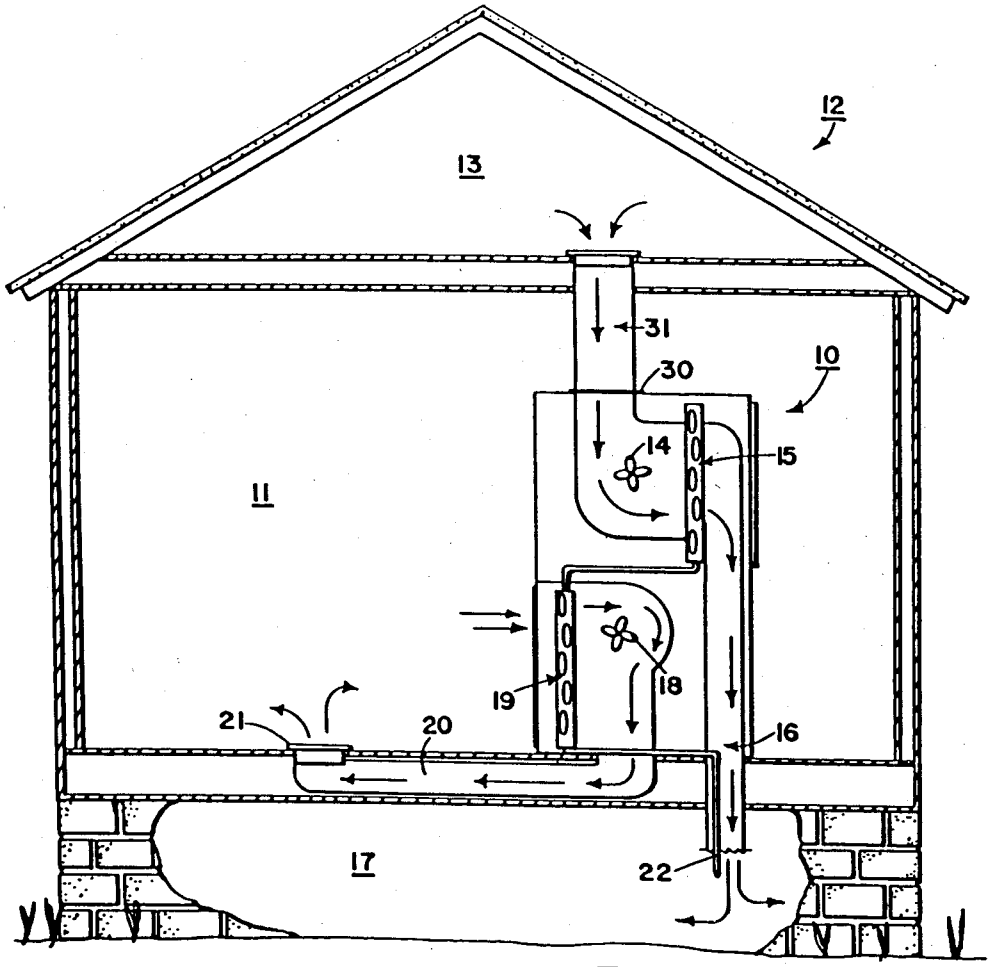
FIG. 1 is a schematic view of the left side of the heat pump of the invention as may be installed in a permanent residential structure.

Turning now to the drawings, FIG. 1 demonstrates in schematic fashion heat pump 10 positioned in room 11 of building 12 which may be for example a small house or office building. Attic area 13 may have a large heat buildup during summer months and as shown air from the attic area is directed by upper fan 14 through upper condenser-evaporator 15 and is subsequently exhausted through the bottom of heat pump 10 through exterior exhaust duct 16 into crawl space 17 below building 12. Thus, a separate exhaust fan is not needed for attic area 13 and upper fan 14 tends to pressurize crawl space 17 by its continual direction of excess air thereto. In addition to the exterior air flow as just described, interior room air is forced by lower fan 18 through lower second condenser-evaporator 19 where it is conditioned and passes through interior duct 20, through vent cover 21 and back into room 11. Lower condenser-evaporator drain line 22 is shown inside exterior exhaust duct 16 and no separate drain line opening must be provided within the subflooring or bottom of heat pump 10.

Figure 2:
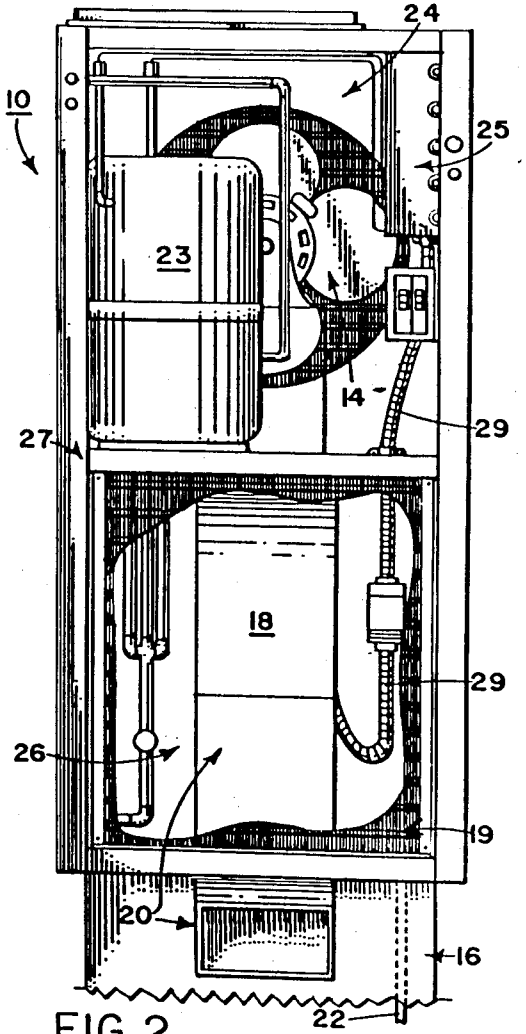
FIG. 2 is an enlarged front view with the lower condenser-evaporator cut-away.

In FIG. 2, an enlarged front view of heat pump 10 is shown whereby compressor 23 is positioned in upper compartment 24 along with upper fan 14 and control box 25. Upper fan 14 is of the propeller type having a one quarter horsepower motor 32 rated at 230 volts, 60 cycles to provide 950 c.f.m.

Lower compartment 26 of heat pump housing 27 includes lower fan 18 which is commonly referred to as a "squirrel cage" fan and is also rated 950 c.f.m., 230 volts, 60 cycles and is one third horsepower. As further shown, lower condenser-evaporator 19 demonstrated in cut-away fashion in FIG. 2 provides for interior air passing therethrough to lower fan 18 where it is exhausted through interior exhaust duct 20 and back into room 11. Service line 29 provides the electrical power required to operate lower fan 18. Exterior exhaust duct 16 is shown positioned behind interior exhaust duct 20 in FIG. 2 and drain line 22 is demonstrated as being within exterior exhaust duct 16 as earlier described.

Figure 3:
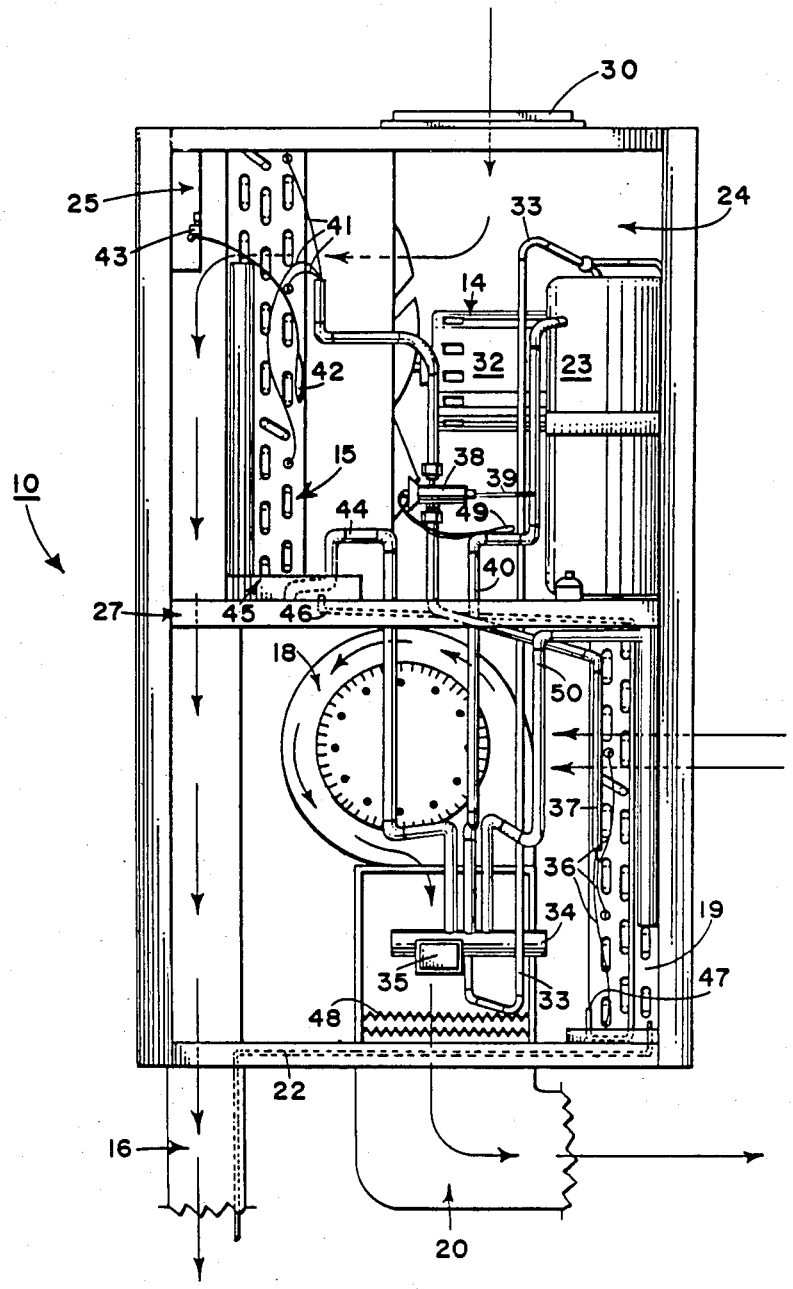
FIG. 3 is an enlarged view of the right side of the heat pump as shown in FIG. 1.

In FIG. 3, attic duct connector 30 is shown without attic duct 31. As would be understood, air from attic area 13 as demonstrated in FIG. 1 passes through attic duct connector 30 and through upper condenser-evaporator 15 and is exhausted through exterior exhaust duct 16. Upper fan 14 is powered by upper fan motor 32 which may be for example a one quarter horsepower motor sized to move 950 c.f.m. This size upper fan has been found sufficient when cooling capacity of heat pump 10 is rated at 2 tons and other fan types such as the "squirrel cage" fan could be employed.

Compressor 23 provides the pressurized refrigerant gas which may be for example freon through outlet line 33 and into reversing valve 34 which is controlled by solenoid 35 affixed thereto as in conventional refrigerant directional reversing systems. If the thermostats (not shown) in control box 25 call for heat, reversing valve 34 directs the hot refrigerant gas into line 37 which carries it into lower condenser-evaporator 19. Condenser-evaporator 19 then provides heat to warm the room air passing thereacross whereby such warm air is returned through interior exhaust duct 20 back to the interior of building 12 as shown in FIG. 1. The refrigerant liquid exits lower condenser-evaporator 19 through the small copper conduit lines 36 shown as three lines in FIG. 3. Copper conduit lines 36 may be approximately $\frac{1}{4}$ inch in diameter and provide adequate capacity within the system as shown although other sizes and numbers of lines may be utilized on different systems. Copper conduit lines 36 distribute the refrigerant into line 37 which passes the refrigerant into expansion valve 38. Expansion valve 38 includes external equalizer line 39 which is joined to suction or low pressure line 40. A cap (capillary) tube device may be used in place of expansion valve 38 as is conventional within the trade. Expansion valve 38 also includes temperature sensor 49 which is affixed to suction line 40 which senses the temperature of the return refrigerant prior to its entry into compressor 23. Expansion valve 38 reduces the pressure of the refrigerant prior to entry into conduit lines 41 which direct the refrigerant into upper condenser-evaporator 15.

In order to maintain the operation of upper condenser-evaporator 15, especially during such times as the attic temperature may drop to approximately 45° F. or lower, which would cause condenser-evaporator 15 to be covered and blocked by frost, defrost sensor 42 is affixed to condenser-evaporator 15 and is joined to defrost timer 43 in control box 25. If condenser-evaporator 15 falls below a prescribed, adjustable temperature level, defrost timer 43 times out and the refrigerant direction is reversed to remove the frost buildup from condenser-evaporator 15 as in conventional heat pump system defrosters. The refrigerant passing through conduit lines 41 exits condenser-evaporator 15 through line 44 where the refrigerant then passes back into reversing valve 34, through suction line 40 and back into compressor 23, thus completing its flow for the heating cycle.

Figure 4:
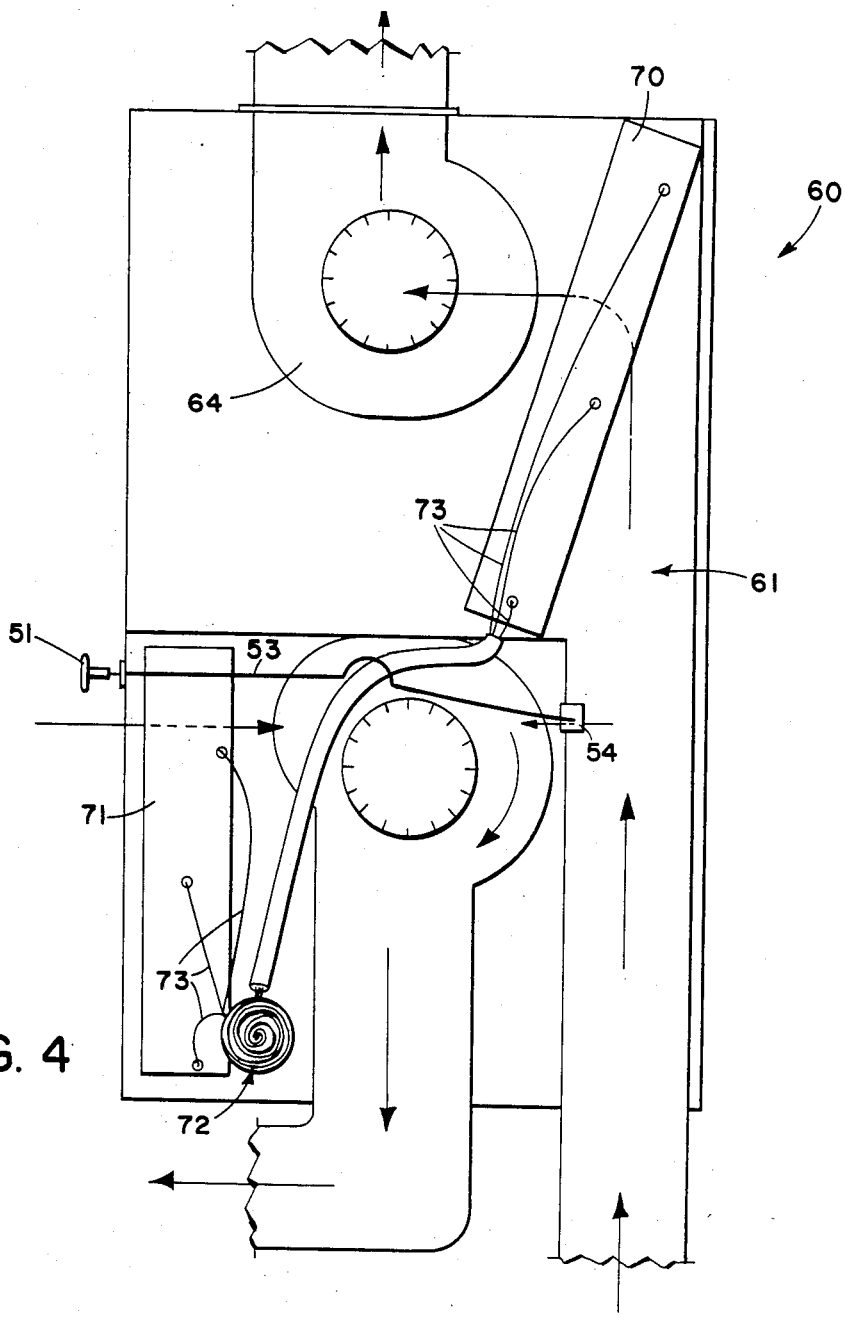
FIG. 4 is a schematic right side elevational view of a second embodiment of the heat pump.
Figure 5:
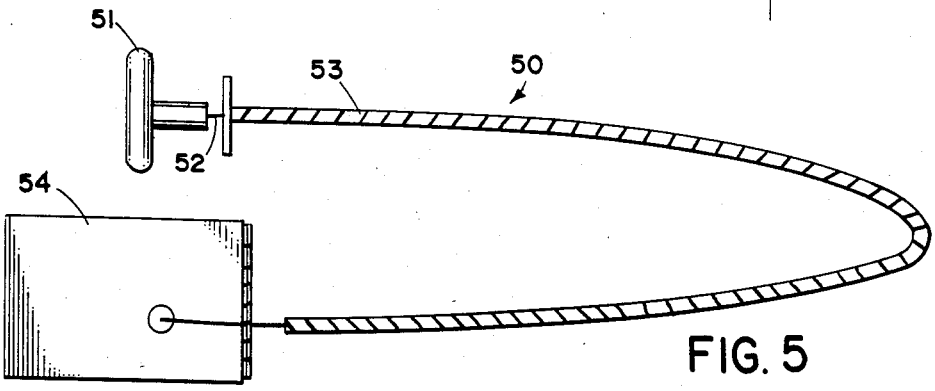
FIG. 5 shows an enlarged view of the fresh air vent cover and mechanism as shown in FIG. 4.

Condenser-evaporators 15 and 19 are shown mounted in a vertical fashion but may be tilted or slanted in order to improve air passing therethrough. Additionally, outdoor air from attic area 13 may be adjustably vented into interior exhaust duct 20 to provide a control mix of indoor and outdoor air for the interior of the building as shown by vent control 50 in FIG. 5. Handle 51 is attached to wire 52 contained within flexible coiled conduit 53 to operate hinged vent cover 54. The positioning of handle 51 and vent cover 54 is illustrated in FIG. 4 and as understood by pulling handle 51 vent cover 54 opens to allow additional fresh air to exit rear duct 61 within heat pump 60. The fresh air is shown in heat pump 60 in FIG. 4 as moving upward through squirrel cage fan 64 and exhausting into the attic or other location as required.

Also during the heating cycle, condensate is collected in upper drain tray 45 and is passed through drain line 46 into lower compartment 26 to provide humidity as air exits lower condenser-evaporator 19. The height of drain line tip 47 can be moved as required to provide the proper humidity supplement. For example, if additonal humidity is required drain line tip 47 is moved upwardly to the vertical middle of lower condenser-evaporator 19 and if less humidity is required, drain line tip 47 is positioned near the bottom of condenser-evaporator 19 as shown in FIG. 3.

During the cooling cycle, the refrigerant direction is reversed from that as described in the heating cycle whereupon it first passes through reversing valve 34 from compressor outlet line 33 and into upper condenser-evaporator 15 which acts as a condenser whereas lower condenser-evaporator 19 acts as an evaporator during the cooling cycle.

The compactness of heat pump 10 is a highly desirable quality since mobile homes, modular buildings and other small structures have limited space and the vertical, interior arrangement of the upper and lower compartments within housing 27 is advantageous to both the installer and owner.

As further shown in FIG. 3, upper condenser-evaporator 15 is positioned proximate the left side of housing 27 whereas lower condenser-evaporator 19 is positioned along the right side of housing 27, also as shown in FIG. 3. These opposingly positioned condenser-evaporators allow for a gradual sloping of drain line 46 and provide for a large volume of usable space in the relatively small interior of housing 27 for sufficiently sized fans, compressors, ducts and other components contained therein. Also, as heat pump 10 exhaust through the bottom of housing 27, it is not necessary to position heat pump 10 against an exterior wall as it may be more usable conveniently located within the interior of a building or mobile home.

Heat pump 60 as shown in FIG. 4 includes upper condenser-evaporator 70 and lower condenser-evaporator 71 of equal dimensions and capacities. As both condenser-evaporators are of the same dimensions an efficient heat pump is provided which has furnished heating and cooling capacities in standard tests as follows:

| COOLING CAPACITY PER ARI 210-81 | |
|---|---|
| 80° F.D.B. - 67° W.B. Inside - 95° Outside | |
| BTU/hr | 26,000 |
| Watts | 2940 |
| E.E.R. | 8.85 |
| HEATING CAPACITY PER ARI 240-81 | |
| 47° R.D.B. - 43° R.W.B. Outside<br>70° F.D.B. Inside | |
| BTU/hr | 27,190 |
| Watts | 2530 |
| C.O.P. | 3.15 |

The compactness of heat pump 60 is also believed to contribute to its efficient operation in that the shortened freon-containing lines between condenser-evaporators make heat pump 60 very temperature response sensitive and by use of cap (capillary) tube 72 as shown in FIG. 4 a better C.O.P. in heating and a better E.E.R. in cooling is realized. It is understood the cap tube 72 replaces expansion valve 38 (FIG. 3) and cap tube 72 comprises a trio of coiled copper tubes 73 having an i.d. of approximately 0.026 to 0.036 inches.

Auxiliary electrical resistance heaters 48, known as "strip heaters" are shown in FIG. 3 and are available if additional heat requirements are needed under extreme weather conditions. The use of heaters 48 is controlled by a thermostat (not shown) within control box 25.

The examples and drawings presented herein are for illustrative purposes and not intended to limit the scope of the appended claims.

I claim:

1. A self-contained indoor air conditioning system of the type having a compressor, an indoor air condenser-/evaporator coil, an outdoor air condenser/evaporator coil, an indoor blower fan, and an outdoor blower fan, all assembled to form a closed refrigerant circuit for providing conditioned air to a dwelling or other enclosed structure, said system further comprising:

an enclosed housing having a top, a bottom, a front wall, a back wall and two side walls;

said housing being subdivided into an indoor air compartment and an outdoor air compartment;

a substantially vertically oriented outdoor air intake means for providing an intake air passageway between said outdoor air compartment and a first unconditioned air space;

a substantially vertically oriented outdoor air discharge means for providing a discharge air passageway between said outdoor air compartment and a second unconditioned air space;

said outdoor air compartment, said outdoor air intake means and said outdoor air discharge means forming an outdoor air flow circuit through said outdoor air compartment;

indoor air return means for providing a return air passageway between said indoor air compartment and the conditioned air space; and indoor air discharge means for providing a conditioned air discharge passageway between said indoor air compartment and the conditioned space.

2. The system of claim 1, wherein said outdoor air compartment and said indoor air compartment are substantially vertically aligned, said outdoor air compartment being located substantially above said indoor air compartment.

3. The system of claim 2 wherein the compressor is mounted within said outdoor air compartment substantially above the indoor air condenser/evaporator coil.

4. The system of claim 2, wherein said outdoor air intake means comprises a vertically oriented duct communicating with said outdoor air compartment through said top of said housing, a portion of said duct being in a heat exchange relationship with the conditioned air space.

5. The system of claim 4, wherein the dwelling includes an attic space above the conditioned air space and said outdoor air intake means comprises an air passageway between said outdoor air compartment and the attic space.

6. The system of claim 5, wherein the dwelling includes a crawl space below the conditioned air space and wherein said outdoor air discharge means comprises an air passageway between said outdoor air compartment and the crawl space.

7. The system of claim 2, wherein said outdoor air intake means comprises a vertically oriented passageway communicating with said outdoor air compartment through said bottom of said housing, a portion of said passageway being in a heat exchange relationship with the conditioned air space.

8. The system of claim 2, wherein said outdoor air intake means comprises a vertically oriented passageway communicating with said outdoor air compartment through said bottom of said housing, a portion of said passageway being in heat exchange relationship with said indoor air compartment.

9. The system of claim 7, wherein the dwelling includes a crawl space below the floor of the conditioned air space, and wherein said outdoor air intake means comprises an air passageway between said outdoor air compartment and the crawl space.

10. The system of claim 9, wherein the dwelling includes an attic space above the conditioned space, and wherein said outdoor air discharge means comprises an air passageway between said outdoor air compartment and the attic space.

11. The system of claim 2 wherein:

said indoor air return means comprises an air passageway formed in said front wall of said housing;

said indoor air discharge means comprises an air duct communicating with said indoor air compartment through a passageway formed in said bottom of said housing.

12. The system of claim 11, wherein:

said indoor air compartment is adapted to provide a mounting for the indoor coil adjacent the front wall of said housing near said indoor air passageway; and said outdoor air compartment is adapted to provide a mounting for the outdoor coil adjacent said back wall of said housing.

13. The system of claim 12, wherein the indoor blower fan is mounted adjacent the indoor coil so as to draw indoor air through said indoor air return means over the indoor coil and discharge conditioned air through said indoor air discharge means, said system further comprising:

vent means for venting said indoor air compartment to said outdoor air circuit.

14. The system of claim 11, wherein said indoor air compartment is defined by a portion of said front wall and said side walls of said housing, a vertical indoor air compartment rear wall mounted to said housing bottom between said front wall and said back wall, a horizontal indoor air compartment top wall extending between said side walls and from said housing front wall to said rear wall; and wherein a portion of said outdoor air circuit is defined by the substantially vertical passageway formed between said indoor air compartment rear wall, said housing back wall and portions of said housing side walls.

15. The system of claim 13, wherein said outdoor condenser/evaporator coil is mounted in said outdoor air compartment adjacent said housing rear wall, said outdoor coil being inclined so as to have its upper extremity adjacent the junction of said housing top and rear walls and its lower extremity adjacent the junction of said indoor air compartment top and rear walls.

16. The system of claim 14 further comprising vent means for selectively venting said indoor air compartment to said outdoor air circuit.

17. The system of claim 16 wherein said vent means comprises a flapper valve mounted in said rear wall of said indoor air compartment operable to induce unconditioned air from said outdoor air circuit into the discharge air stream within said indoor air compartment.

18. Apparatus for conditioning the interior air of a building comprising: a housing, said housing having an upper and lower compartment, said compartments positioned one over the other within said housing, said housing entirely within the interior of the building, air conditioning means, said air conditioning means positioned within said housing, a first vertical duct, said first duct for handling fresh exterior air, a second vertical duct, said second duct for handling conditioned interior air, at least a portion of said first and said second ducts positioned within said housing, vent means, said vent means positioned within said housing on said first duct, said vent means being adjustable, said vent means for allowing fresh exterior air to pass from said first duct into said second duct whereby conditioned interior air is mixed with fresh exterior air.

* * * * *